US005743780A

United States Patent [19]

Liu

[11] Patent Number: 5,743,780

[45] Date of Patent: Apr. 28, 1998

[54] STRUCTURE FOR DRIVING TOYS BY MAGNETIC FORCES

[76] Inventor: Jack Liu, No. 3, Alley 202, Kao-Fon Rd., Hsin-Chu City, Taiwan

[21] Appl. No.: 779,222

[22] Filed: Jan. 6, 1997

[51] Int. Cl.[6] ..... A63H 33/26; G09F 19/00

[52] U.S. Cl. ..... 446/136; 40/406

[58] Field of Search ..... 40/406, 411, 428, 40/429, 430, 435; 446/129, 133, 134, 135, 136, 139, 267, 330, 332, 352, 357, 358

[56] References Cited

U.S. PATENT DOCUMENTS

| | | | |
|---|---|---|---|
| 3,006,111 | 10/1961 | Koch | 446/136 |
| 4,177,592 | 12/1979 | Ruck | 446/136 X |
| 5,070,633 | 12/1991 | Liu | 40/411 |
| 5,090,144 | 2/1992 | Liu | 40/411 X |
| 5,417,605 | 5/1995 | Chan | 446/436 |
| 5,435,086 | 7/1995 | Huang | 446/136 X |

FOREIGN PATENT DOCUMENTS

| | | | |
|---|---|---|---|
| 1129930 | 1/1957 | France | 446/136 |

*Primary Examiner*—D. Neal Muir

*Attorney, Agent, or Firm*—Beveridge, DeGrandi, Weilacher & Young, L.L.P.

[57] ABSTRACT

A structure in which a toy is driven by a magnetic force including a rotary disk having a plurality of inner magnets thereon, with one magnet located at the center of the disk and the other magnets spaced therefrom. The polarity of the magnet in the center of the disk is different from the polarity of the remaining magnets. A mirror is mounted over the outer magnets and a plurality of inner magnets, each bearing a toy, are supported on the mirror. The polarity of the outer magnets is opposite the polarity of the inner magnets and is the same as the polarity of the inner magnet at the center of the rotary disk. The rotary disk may be driven to rotate by an outer driven wheel which, in turn, is rotated by a driven claw. The rotary disk is supported above a fixing disk. The driven wheel engages and rotates the rotary disk, causing movement of the outer magnets and toys on the mirror along the path of rotation of the inner magnets due to the magnetic attraction between the magnets of opposite polarities. The outer magnets are repelled from movement toward the center inner magnets because of their similar polarities with the inner magnet at the center of the rotary disk. The fixing disk engages an annular groove in a cylindrical substrate that tightly secures the mirror without the use of adhesives.

7 Claims, 3 Drawing Sheets

STRUCTURE FOR DRIVING TOYS BY MAGNETIC FORCES

BACKGROUND OF THE INVENTION

1. Field of the Invention

The present invention relates to a structure in which a toy is driven by a magnetic force, especially, in which a toy on a smooth surface is driven to rotate by magnetic forces from opposite polarities.

2. Description of the Prior Art

The prior structure of a toy on a smooth surface driven by the attractive force of opposite polarities is shown in FIG. 4 or U.S. Pat. No. 4,757,986, wherein a rotary disk within a wooden base or a substrate is rotated in an axle direction according to the elasticity of a music bell, and a plurality of inner magnets are arranged around the music bell, the upper end of which is sustained a fixed distance with a mirror fixed on the wooden base.

Furthermore, a plurality of toys is positioned on the upper surface of the mirror, and a plurality of outer magnets is installed on the base of the toy. Accordingly, the inner and outer magnets are mutually attractive, so that when the rotary disk is rotated, because the friction force between the magnet and the mirror is very small, the outer magnet is moved with the inner magnet in order that said toy exhibits a dynamic phenomenon.

Since the attractive force between the two magnets is inversely proportional to their distance, the gap between the two magnets must be controlled within an effective range to be mutually attracting. In the structure, the rotary disk is connected with a center axle, and the crown gear is directly engaged with the gear of a music box below the center axle. Therefore the position of the inner magnet with respect to the music box may be adjusted within a small margin. Consequently, when the assembly precision of the assembly of the music box and the wooden base or the assembly of the wooden base and the mirror are shifted, then the magnet will touch the ground. Otherwise, the distance between the inner magnet and the mirror is too large. Since the assembly precision is difficult to control, the toy on the mirror can not move effectively.

SUMMARY OF THE INVENTION

Accordingly, the present invention relates to a structure in which a toy is driven by a magnetic force. This structure is mainly comprised of a rotary disk having a magnet on a fixing disk. The rotary disk may be driven to rotate by an outer driven wheel. The periphery of the fixing disk is resisted against a mirror by an elastic force deriving from the peripheral elasticity on the fixing disk. Therefore, the gap between the magnet and the mirror may be sustained within an effective range.

According to the assembly of the structure described hereinabove, the rotary disk having magnets is contained within a fixing disk and is supported thereby. Therefore, when the fixing disk is resisted against the surface of the mirror, the gap between the magnet of the rotary disk and mirror may be asserted, thus the attractive force of the magnet is not reduced by the assembly precision between the music bell and the wooden base or the wooden base and the mirror.

BRIEF DESCRIPTION OF THE DRAWINGS

The invention, as well as its many advantages, may be further understood by the following description and drawings in which.

DETAILED DESCRIPTION OF THE PREFERRED EMBODIMENT

Figure 1:
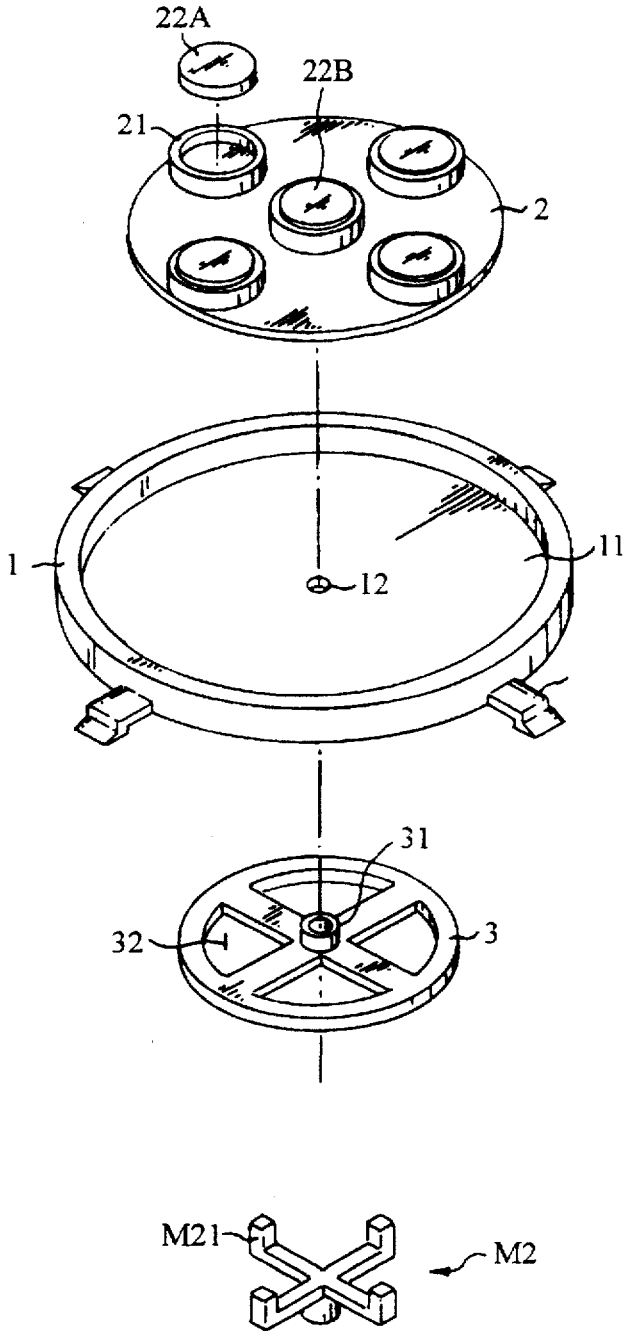
FIG. 1 shows the perspective view of the assembly of a fixing disk, a rotary wheel, a driven wheel and a driven claw.

The detailed structure of the present invention is shown in the FIG. 1, wherein a groove (11), the center of the bottom of which has an axle hole (12), is located in the center of a fixing disk (1). A plurality of elastic pieces (13) are integrally connected about the periphery of said fixing disk (1). In the present embodiment, each of the elastic pieces is arranged with an equal angle therebetween.

Moreover, a rotary disk (2), the diameter of which is much smaller than that of said groove (11) of the fixing disk (1), is installed such that the rotary disk is within the range of said groove (11), and a plurality of circular positioning bases (21) is located on the center and around the periphery of the upper surface of the rotary disk (2), while a pair of inner magnets (22A, 22B) are fixed on the positioning base (21), wherein the polarities of the inner magnet 22A and inner magnet 22B are opposite. A center axle (23) is extendedly coupled to the lower surface of the rotary disk (2), and the center axle (23) is engaged with the axle hole (12) of the fixing disk (1), therefore, the rotary disk may be rotated around the center axle (23) within the groove (11) of the fixing disk (1).

The total height from the lower surface of said rotary disk (2) to the inner magnets (22A, 22B) is set to be smaller than that of said groove (11) of said fixing disk (1). That is, when the rotary disk (2) is positioned on the groove (11) of said fixing disk (1), the inner magnets (22A, 22B) extend out from the peripheral level of said fixing disk.

Furthermore, a driven wheel (3), the center of which has a circular engaging base (31), is connected to the rotary disk (2) by said engaging base (31). The disk surface of said driven wheel (3) has a plurality of apertures (32). In the present embodiment, the driven wheel has four apertures.

Figure 2:
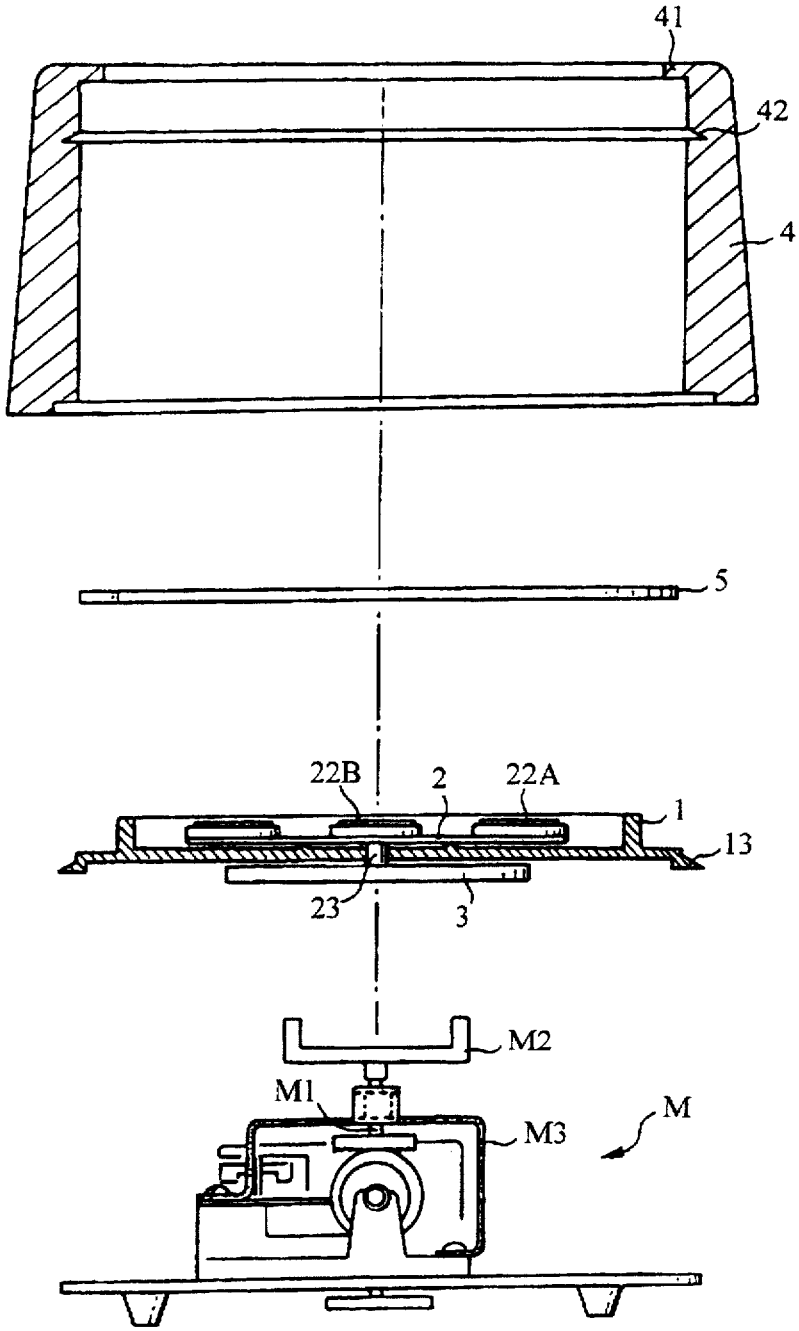
FIG. 2 is a schematic assembly view of the present invention.

Another feature as shown in FIG. 2 is a cylindrical substrate (4) which is made of wood or plastic material, and the inner diameter is slightly smaller than that of the elastic pieces (13) of said fixing disk (1). A flange (41) extends from the upper edge of the substrate (4), wherein the diameter of said flange is slightly smaller than that of said substrate (4). A circular concave ring (42) is disposed about the inner periphery of the substrate (4) below the flange (41), wherein the diameter of said concave ring (42) is the same as said elastic piece (13) of said fixing disk (1), and the gap of said concave ring (42) is also equal to the width of said elastic piece (13) so that the elastic piece may be engaged with said concave ring (42).

A mirror, the upper surface of which is smooth, is inserted into said substrate (4) and rests against the lower surface of the flange (41).

Figure 3:
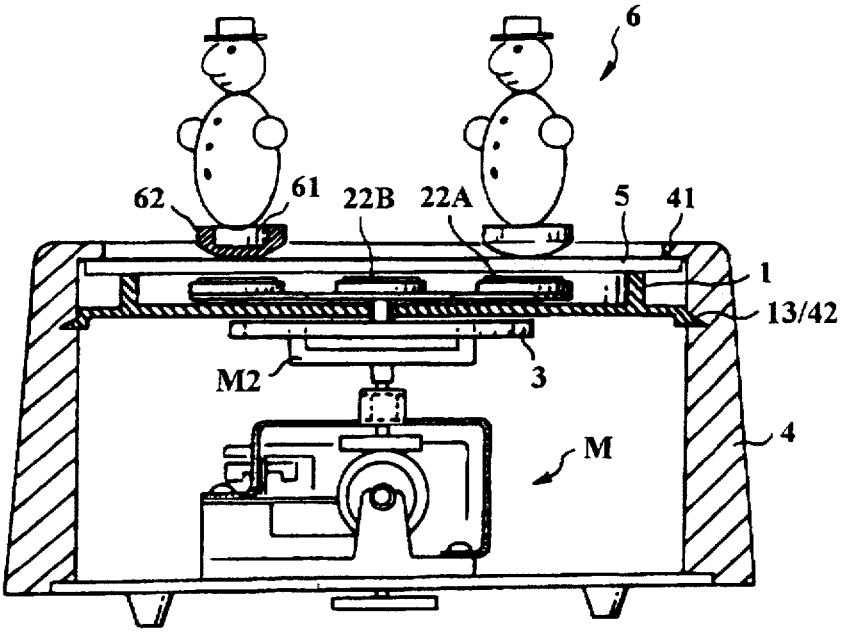
FIG. 3 is a schematic cross sectional view of the present invention.
Figure 4:
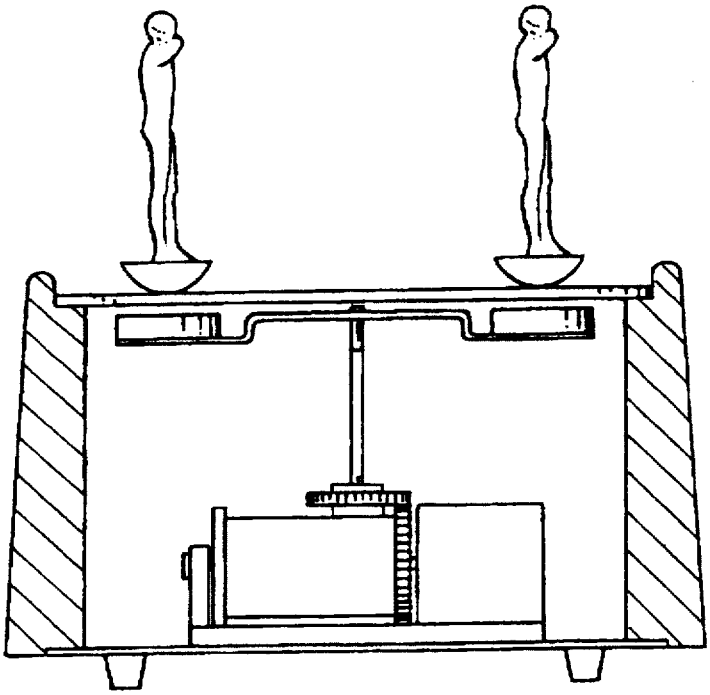
FIG. 4 (PRIOR ART)
FIG. 4 is a schematic cross sectional view of the prior art.

In the present invention, the gap between the lower surface of said flange (41) and the said concave ring (42) is slightly smaller than the width of said mirror plus the height from the elastic piece (13) to the upper surface of said fixing disk (1), therefore, when said elastic pieces (13) are coupled with the concave ring (42) of said substrate (4), not only is said fixing disk (1) supported on a predetermined position of said substrate (4) by said concave ring (42) according to said elastic pieces (13), but also, an elastic force is generated by said elastic pieces (13) so that said fixing disk has a resistance against said mirror (5), as shown in FIG. 3. Therefore, the fixing disk (1) is tightly coupled with said mirror without using any adhesive agent for preventing the silvered surface layer from separating from the mirror due to using an adhesive agent, or for preventing the gap between the magnet (22) within said rotary disk (2) and mirror (5) from shifting due to error in the assembly precision between said mirror (5) and said substrate (4).

Moreover, a music bell (M) is driven by a spring on the bottom of said substrate (4). A driven claw (M2), positioned on the upper edge of a rotary axle (M1), is rotated by the output power from the music bell (M) through a longitudinal axle (m1) which is supported on the frame (M3) of said music box (M).

Said driven claw includes a plurality of nose portions (M21) with respect to the opening (32) of said driven wheel. As said music box is assembled on the predetermined position of the substrate (4), said nose portions (M21) of said driven claw (M2) extend within the range of said opening (32) of said driven wheel (3), so that the driven wheel (3) is driven to rotate.

The assembly of said fixing disk (1), said rotary disk (2), said substrate (4) and said mirror (5), said fixing disk (1) and said mirror (5) may be steadily positioned in the corresponding position of said substrate (4). The rotary disk (2) is also driven to rotate in the groove (11) of said fixing disk (1), thus the gap between said inner magnet (22) and said mirror (5) is within a predetermined range without being adjusted. Of further importance, the power transmission between said rotary disk (2) and said music bell (M) is made by matching the driven claw (M2) with a type of clutch and driven wheel (3). Therefore, when the assembly precision between said music bell (M) and said substrate (4) is not within the required range, the rotary disk (2) is also driven to rotate effectively by the driven claw (M2) and is not interrupted.

Moreover, as shown in FIG. 3, it is assumed that there is more than one toy (6) fixed on the outer magnet (61) in the lower part, and the outside of said outer magnet is covered by a plastic cover (62). The plastic cover that contacts the surface of the mirror (5) is shaped as a circular curve.

Because the weight of the outer magnet is larger than that of said toy (6), therefore said toy (6) stands on the mirror (5) as a tumbler. Moreover, said toy (6) does not stand on the mirror (5) in a normal direction. That is, said toy (6) is shifted to an angle longitudinal with the normal direction of said mirror (5).

Furthermore, said polarity of said outer magnet (61) with respect to said toy (6) is set to be opposite to that of said inner magnet (22). Therefore, when said toy (6) is located in the respective position of the rotary disk of said magnet (22), the outer magnet (61) is attracted by said inner magnet (22A). When said rotary disk (2) is driven to rotate by said music bell (M), the toy (6) is moved along the trace of said inner magnet (22A) by the attraction force of said inner magnet (22A). The longitudinal direction of said toy (6) forms an angle with the normal direction of said mirror (5), so that the toy (6) spins by itself during moving. Thus, the present invention provides dynamic phenomenon.

In order to prevent the toy (6) from moving toward said mirror (5) during it being driven, an inner magnet (22B), the polarity of which is opposite to that of inner magnet (22A) is located on the center of said rotary disk (2). Thus, the repulsive force between said inner magnet (22B) and said inner magnet (22A) will prevent said toy (6) from being moved toward said mirror (5).

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

I claim:

1. A structure for driving a toy by magnetic force comprising a rotary disk having an upper surface and a lower surface, a plurality of positioning bases on the upper surface of said rotary disk and spaced from each other, one of said positioning bases being positioned in the center of said upper surface of said rotary disk, each of said positioning bases supporting a separate, inner magnet, the polarity of the inner magnet on the positioning base located in the center of said rotary disk being opposite to the polarity of the magnets in the other positioning bases, a center axle extending downwardly from the center of said lower surface of said rotary disk, a fixing disk having a wall extending upwardly about its periphery, said fixing disk having an axle hole extending through the center thereof for receiving said center axle, said fixing disk having a plurality of elastic pieces connected thereto and extending from an edge of said fixing disk, a driven wheel disposed below said fixing disk and having a plurality of spaced apertures therethrough, said driven wheel having an engaging base extending upwardly from the center of an upper surface of said driven wheel, said engaging base extending through said axle hole in said fixing disk and drivingly engaging said center axle of said rotary disk, a driven claw having a plurality of nose portions, each of said nose portions engaging one aperture of said plurality of apertures in said driven wheel, and a rotary axle on said driven claw, a cylindrical substrate having a flange extending inwardly about the upper edge of said substrate and an annular groove on the inner surface of said substrate and spaced from said flange, said elastic pieces of said fixing disk engaging said annular groove and supporting said fixing disk within said cylindrical substrate, a mirror supported by said wall of said fixing disk and disposed beneath said flange, a plurality of outer magnets corresponding to said inner magnets on said rotary disk except for the inner magnet on the center of the rotary disk, each of said plurality of outer magnets disposed within a cover having a curved outer surface for contacting an upper surface of said mirror above an inner magnet, the polarity of said outer magnets being the opposite of the polarity of said inner magnets, a toy positioned on each of said outer magnets, whereby movement of said inner magnets of said rotary disk results in corresponding movement of the toys on the outer magnets, and means for imparting a rotary movement to said rotary axle of said driven claw to cause rotation of said driven wheel and said rotary disk.

2. The structure as defined in claim 1 wherein each of said elastic pieces of said fixing disk are equally spaced about said periphery of said fixing disk.

3. The structure as defined in claim 1 wherein each of said toys shifts positions so as to form an angle between a normal direction to said mirror and said toy.

4. The structure as defined in claim 1 wherein said driven wheel has four apertures.

5. The structure as defined in claim 1 wherein the height of an inner surface of said wall on said fixing disk is greater than the distance from said lower surface of said rotary disk to an upper surface of said inner magnets.

6. The structure as defined in claim 1 wherein the diameter of the inside of said fixing disk is greater than the diameter of said rotating disk.

7. The structure as defined in claim 1 wherein said covers for said outer magnets are plastic covers.

* * * * *